US008484923B2

(12) United States Patent
Wendt

(10) Patent No.: US 8,484,923 B2
(45) Date of Patent: Jul. 16, 2013

(54) BI-PARTING ACCESSIBLE CEILING SYSTEM

(75) Inventor: Alan C. Wendt, Inverness, IL (US)

(73) Assignee: USG Interiors, LLC, Chicago, IL (US)

( * ) Notice: Subject to any disclaimer, the term of this patent is extended or adjusted under 35 U.S.C. 154(b) by 135 days.

(21) Appl. No.: 12/960,580

(22) Filed: Dec. 6, 2010

(65) Prior Publication Data

US 2012/0137615 A1 Jun. 7, 2012

(51) Int. Cl.
*E04B 9/00* (2006.01)

(52) U.S. Cl.
USPC ..... 52/506.06; 52/506.07; 52/506.01

(58) Field of Classification Search
USPC ..... 52/220.6, 506.01, 506.06–506.1
See application file for complete search history.

(56) References Cited

U.S. PATENT DOCUMENTS 3,798,865 A * 3/1974 Curtis ..... 52/665
4,535,580 A 8/1985 Shirey
4,696,142 A 9/1987 Mieyal et al.
4,744,188 A * 5/1988 Ahren ..... 52/506.07
4,779,394 A * 10/1988 Shirey et al. ..... 52/667
5,044,138 A * 9/1991 Zaccardelli et al. ..... 52/667
6,467,228 B1 * 10/2002 Wendt et al. ..... 52/506.07
7,805,904 B2 * 10/2010 Clark et al. ..... 52/506.06

* cited by examiner

*Primary Examiner* — William Gilbert
*Assistant Examiner* — Patrick Maestri
(74) *Attorney, Agent, or Firm* — Pearne & Gordon LLP

(57) ABSTRACT

A suspended ceiling comprising a grid formed of intersecting grid runners and snap-up panels supported on the grid runners, the grid runners dividing a ceiling area into standard modules, the pans being formed of sheet material and each having its sides sized to cover the module size while leaving a space at visible faces thereof between adjacent panels when in an installed position on the grid, at least one adjacent pair of panels being displaceable from their installed positions, the gap between a pair of displaceable panels being closed by a removable runner or the displaceable panels so that when the displaceable panels are displaced from their installed position and any removable runner is removed, an access opening of twice the standard module is made available for accessing the area above the ceiling while adjacent panels at longitudinal ends of the gap between the displaceable panels can remain in respective installed positions.

3 Claims, 4 Drawing Sheets

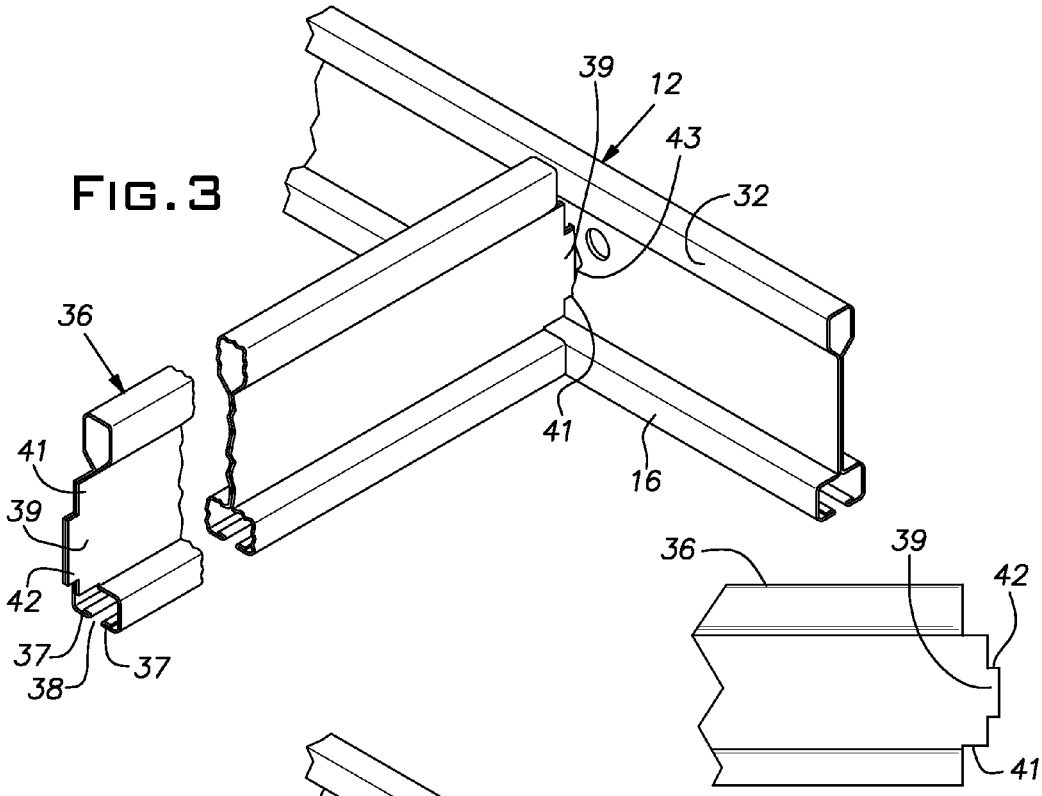
FIG. 3
FIG. 3A
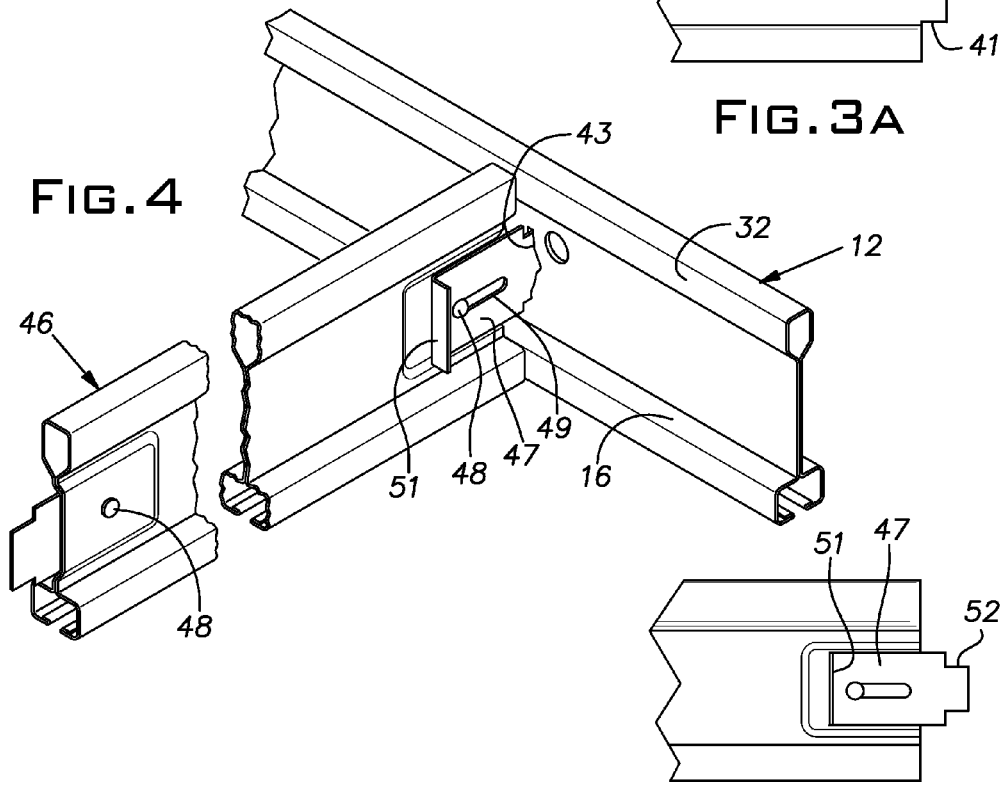
FIG. 4
FIG. 4A

BI-PARTING ACCESSIBLE CEILING SYSTEM

BACKGROUND OF THE INVENTION

The invention relates to suspended ceiling systems and, in particular, to components of such systems that facilitate access to the space above a ceiling.

PRIOR ART

U.S. Pat. No. 4,535,580 discloses a screw slot runner for a suspended ceiling grid and U.S. Pat. No. 4,696,142 discloses a snap-up panel useful with the screw slot style grid runner. U.S. Pat. No. 6,467,228 discloses edge configurations for snap-up panels that serve as hinges to enable the panels to be folded downwardly for access to the space or plenum above the ceiling while remaining supported on the grid.

Panels of the type disclosed in these referenced patents are typically made of metal or rigid plastic sheet stock. Besides affording a distinctive look, this type of panel is quite durable thus making it a good choice where access to the plenum is anticipated to be necessary, especially when it is expected to be relatively frequent. Where the grid spacing and panels are nominally 2'×2' or other standard module size, it is difficult for a technician or tradesman to work or climb through the available opening of a single panel and grid module. Frequently, a grid runner will be damaged by a person operating or passing through the space of an open panel. The damage often is difficult to repair and persons unfamiliar with the nature of the grid connections in an attempt to remove a damaged grid runner can damage other runners to which it is connected, thus compounding the problem.

SUMMARY OF THE INVENTION

The invention provides a convenient, low skill level manner to afford a double size opening in snap-up panel suspended ceiling systems. The system utilizes a special grid cross runner at the location or locations in a ceiling where it is anticipated access will be required. The special runner can be used to replace an original runner anytime after the original ceiling construction is completed.

The specialized grid runner can take various forms, each preferably characterized by a locating feature capable of resisting both up and down forces to facilitate panel installation and removal and to contribute to support an adjustment of a pair of adjacent panels. In alternative embodiments of the invention, the snap-up panels are provided with unique edge formations that provide a faux slot and eliminate the need for a special removable grid runner.

BRIEF DESCRIPTION OF THE DRAWINGS

FIG. 3 is a fragmentary perspective view of a second form of a specialized cross runner;

FIG. 3A is a side elevational view of one end of the cross runner of FIG. 3;

FIG. 4 is a fragmentary perspective view of a third form of a specialized cross runner;

FIG. 4A is a side elevational view of one of the cross runner of FIG. 4;

In various figures, the cross-sectional size of the runners and edge detail of the panels is exaggerated for visual clarity.

DESCRIPTION OF THE PREFERRED EMBODIMENTS

Figure 1:
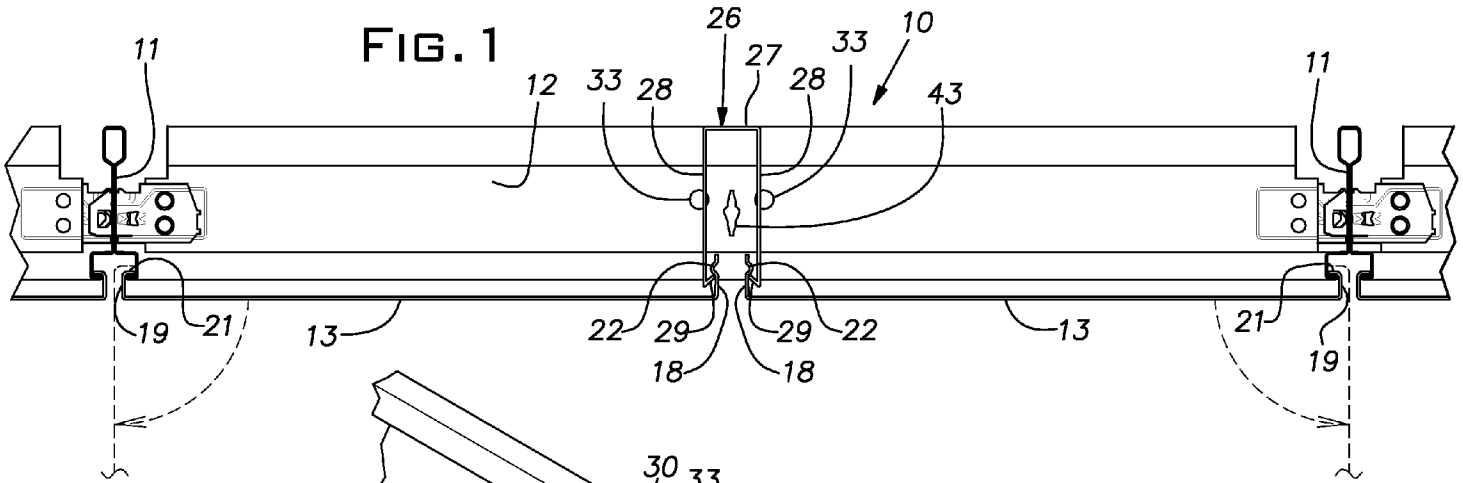
FIG. 1 is a somewhat schematic elevational view of a suspended ceiling system incorporating the invention.
Figure 2A:
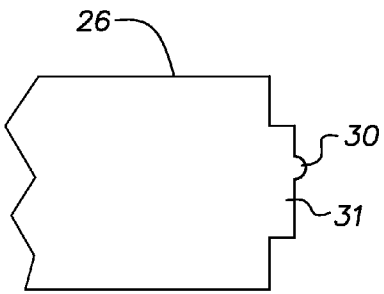
FIG. 2A is a side elevational view of one end of the cross runner of FIG. 2.
Figure 2:
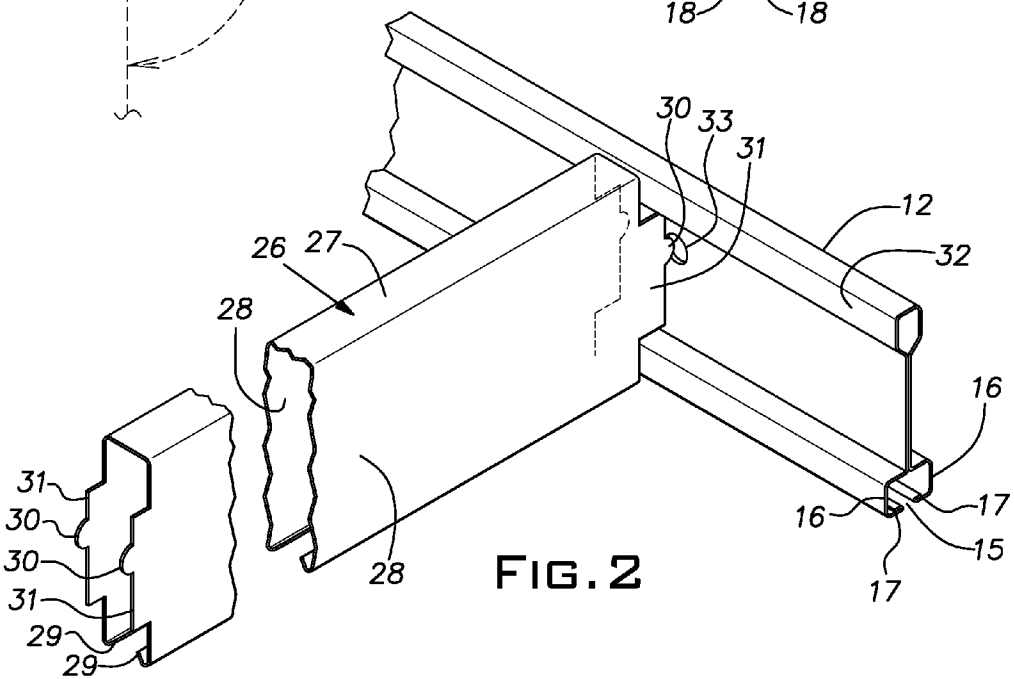
FIG. 2 is a fragmentary perspective view of a first form of a specialized cross runner of the invention.

Referring initially to FIGS. 1, 2 and 2A, there is shown a portion of a suspended ceiling grid system 10. The system 10 includes main runners 11, cross runners 12, and hinge snap-up panels 13. The aforementioned U.S. Pat. Nos. 4,535,580, 4,696,142, and 6,467,228, incorporated herein by reference, disclose various details and aspects of these components. A common manner of constructing a ceiling grid is to use main tees or runners 11, typically 10' or 12' long and joined end-to-end. The main tees 11 are suspended, from overhead superstructure by wires for example, so that they are parallel to one another and are spaced on 4' centers. Dimensions given herein can have metric equivalents depending on the country of origin or use. Nominal 4' long cross runners 12 are assembled in regularly spaced main runner slots. Typically, the 4' cross runners will be spaced on 2' centers. Extending between the 4' long grid runners 12 are nominally 2' long cross runners at least some of which are of the types disclosed hereinafter.

The suspended grid described immediately above is characterized by modular panel spaces of nominal 2'×2' dimension, i.e. their dimensions in the plane of the ceiling. It will be understood that the invention can be used with other standard module sizes.

The standard runners 11, 12 with which the specialized cross runners of the invention to be described are employed, have a central slot or opening 15 on their lower faces formed by opposed C-shaped flanges 16, each terminating at an edge 17.

The rectangular panels 13, preferably made of sheet material such as aluminum or other metal or rigid plastic such as polycarbonate, are pan shaped with vertical sidewalls 18 on their four sides or edges. One sidewall 19 can be incorporated that has an in-turned flange 21 that develops a hinge function explained below. The three other sidewalls 18 have inwardly projecting detent surfaces 22 that releasably catch on the associated edge 17 of a slot or opening 15 of an overlying grid runner 11, 12 or 26.

At strategic locations in the expanse of a suspended ceiling or, if necessary or desirable, generally throughout the ceiling expanse, a pair of hinged snap-up panels 13 can be assembled on the ceiling grid with their relative orientations illustrated in FIG. 1. Where the hinged snap-up panels 13 are not expected to be required, more standard snap-up panels can be used where the panel sidewalls on all four edges of the panel are like the sidewalls 18 illustrated in FIG. 1. The hinge sides 19 of each pair of panels 13 are arranged remote and parallel to one another. The panel sides 18 opposite the respective hinge flanges 21 are adjacent one another and commonly share a cross-runner embodying principles of the invention.

The various specialized cross-runners disclosed herein can have a nominal length of 2', but other nominal dimensions are contemplated. Referring to a specialized cross runner 26 depicted in FIGS. 1, 2 and 2A, the removable cross runner has a U-shaped cross-section. In its installed orientation, the runner 26 has an upper horizontal web 27, parallel spaced vertical sidewalls 28 depending from the web, and in-turned narrow flanges or lips 29 at the lower or distal edges of each sidewall. Preferably, the geometry of the flanges 29 simulates that of the C-shaped flanges 16 forming the slot 15 of the runners 11, 12. Both ends of the cross runner 26 are modified from a plain C-shaped channel to create pairs of connectors 31 that include tabs 30 proportioned to index into holes or openings 33 in the web of the transverse runners 11, 12. The connectors can be fashioned from the original sidewalls of the channel stock from which the runner 26 is made. The connectors 31 are proportioned to closely fit between upper reinforcing bulbs 32 of the main or cross runners 11, 12 and their lower C-shaped flange 16 so that the flanges or lips 29 lie in the same plane as the lower part of the C-shaped flange 16 of the runners 11, 12. In assembled position, the connectors 31, being restrained by the bulb 32 and flange 16 of the runners 12, vertically index the cross runner 26 and prevent it from moving significantly vertically upwardly or downwardly.

The cross runner 26 functions in the same manner as a conventional slot style runner 11, 12 in vertically supporting and horizontally constraining the flange or sidewall 18 of a panel 13. The detent surface 22 in the form of a re-entrant rib or other element snaps over the lip 29 so as to allow the lip to vertically support the panel 13. The vertical force required to snap the detent 22 over the lip 29 is sustained by the connectors 31 bearing against the reinforcing bulb 32 of the transverse runner 12. When the second of the pair of panels 13 sharing the cross runner 26 is snapped in place, the pair of panels 13 will be properly horizontally located.

By snapping the pair of panels 13 down so that they swing about their respective hinge-like flanges 21, access to the plenum above the ceiling 10 is provided. The cross runner 26 can be removed by rotating it slightly about a vertical axis so that an end connector 31 is free of vertical constraint of one of the bulbs 32 of the transverse runner 12 thereby permitting the runner to be lifted or lowered out of the ceiling area. Alternatively, the runner 26 can be slid horizontally towards one of the hinged sides of one of the panels 13. Removal or repositioning of the cross runner 26 essentially doubles the size of an access opening from what would be available when a cross runner is left in place. Thus, when the panels are nominally 2'×2', a nominal 2'×4' opening is available. This larger opening can make it much easier for a person to work or pass through the opening in the grid.

Referring to FIGS. 3 and 3A, another form of a removable cross runner 36 is illustrated. In the various figures, parts that have the same or comparable features or functions are identified by the same numeral as a general rule. The cross runner 36 has the cross-section of a conventional slot-style runner including lips 37 defining a slot 38. The cross runner 36 has a length suitable to fit between a pair of transverse runners spaced 2' apart or some other specified nominal distance. An end connector 39 is formed on a web 40 of the cross runner 36 at each of its ends. The end connector 39 includes a first section 41 proportioned to fit closely vertically between the top of the flange 16 and the underside of the bulb 32 of a transverse runner 12 and a second section 42 proportioned to fit in the conventional connector receiving slot 43 in the web of the transverse runner. The length of the connector second section 42, in the longitudinal direction of the runner 36, projecting from the first section 41 is small, preferably being about 0.3 inch, for example. While in the illustrated form, the end connector 39 is formed of the same sheet metal stock as the cross runner 36, it will be understood that the end connector can be fabricated from a separate piece of metal and permanently rigidly affixed to the respective end of the cross runner.

The cross runner 36 is installed by assembling the second section 42 at each end in the corresponding connector slot or opening 43. The connector first section 41 is proportioned to fit between the flange 16 and bulb 32 of the transverse runner 11. The panels 13 work with the cross runner 36 in essentially the same manner as that described with the cross runner 26 of FIGS. 2 and 2A. When the panels 13 are lowered about their hinge sides 19, the cross runner 36 can be removed. To enable such removal, a transverse runner 12 at one end of the cross runner is rotated about a horizontal axis so that the bulb 32 is forced away from the cross runner and the second connector section 42 is released from the slot 43. At this point, the cross runner can be rotated about a vertical axis or lifted out of position and thereby removed. After the cross runner 36 has been removed access to the plenum has been facilitated. The cross runner 36 can be re-installed by reversing the described removal process and the panels can be raised back into their installed positions.

FIGS. 4 and 4A illustrate modified cross runner 46 having a cross-section like that of the regular slot style grid runner. A retractable connector or clip 47 is disposed on at least one end of the cross runner 46. The connector 47 is captured on a rivet or pin 48 permanently attached to the web of the cross runner 46 and disposed in a slot 49 formed in the connector. The slot 49 enables the connector 47 to be moved longitudinally of the cross runner 46 a limited distance. A finger grip 51 formed as a part of the connector 47 facilitates this action. A forward end section 52 of the connector 47 is proportioned to fit in the connector slot 43 to index the cross runner 46 to a proper center. The forward end section 52 is proportioned to vertically index the cross runner 46 to the transverse runner 12 by fitting closely with the slot 43.

Of the various versions of the removable cross runner, the unit illustrated in FIGS. 4 and 4A is expected to be the most intuitive for those persons unfamiliar with a ceiling system.

Figure 5:
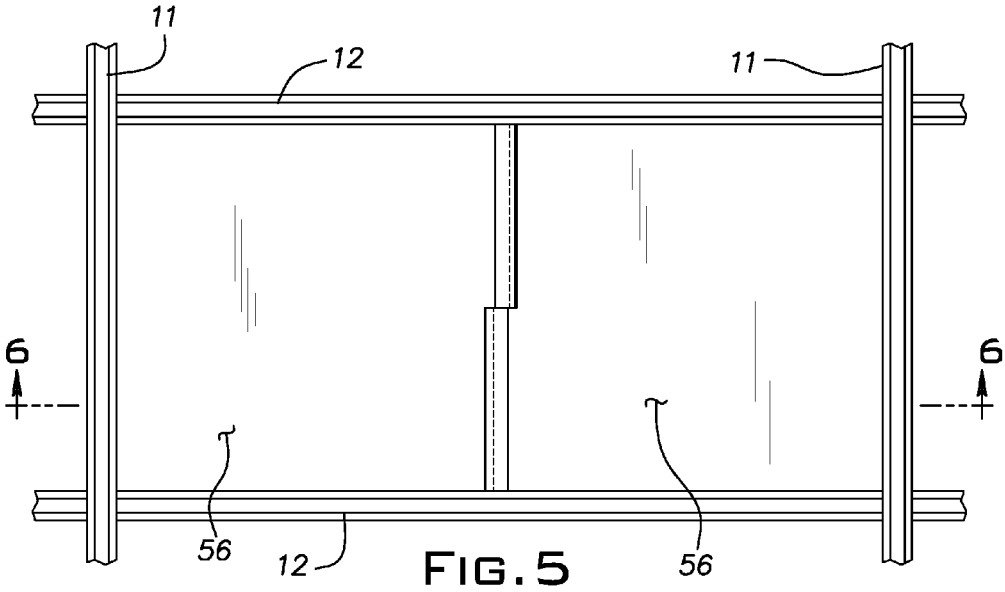
FIG. 5 is a somewhat schematic fragmentary plan view of a suspended ceiling system with snap-up panels having asymmetric edges.
Figure 6:
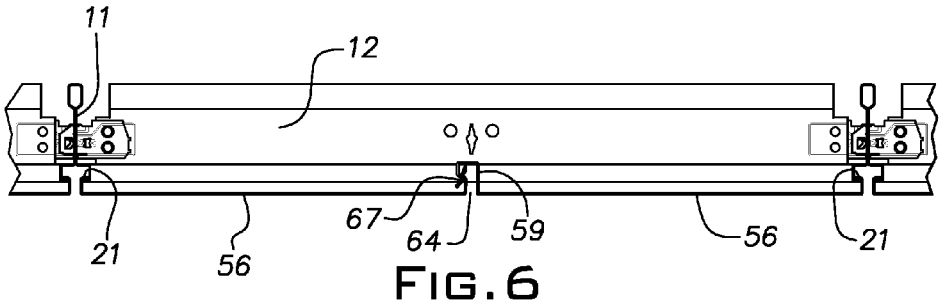
FIG. 6 is a schematic cross-sectional elevational view of the suspended ceiling system of FIG. 5 taken in the plane 6-6 in FIG. 5.
Figure 7:
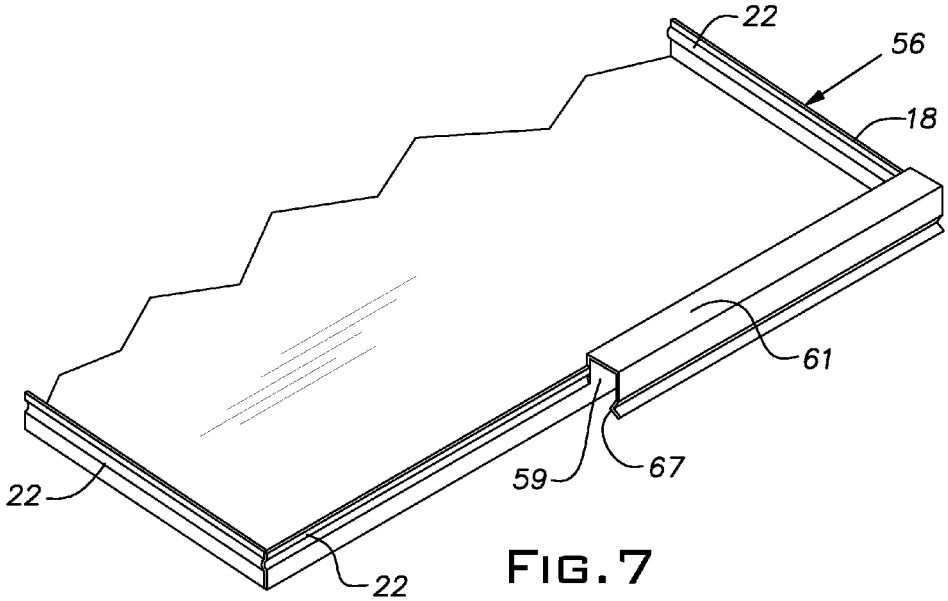
FIG. 7 is a fragmentary isometric view of a ceiling panel used in the embodiment of FIGS. 5 and 6.

Referring to FIGS. 5-7 a pair of panels 56 are installed on a grid of runners which are diagrammatically shown as main runners 11 and cross runners 12 of the slot type. The panels 56 are asymmetrical by virtue of having a sidewall 59 with an integral inverted channel 61 extending along substantially half of the length of the sidewall. The sidewalls 18 along the other edges of the panel 56 are of a standard shape having longitudinally extending detent ribs 22 or hinge side 19. The panels 56 compliment one another when arranged side-by-side and one is orientated a half turn about a vertical axis relative to the other. In this orientation, the half length channels 61 are additive and extend completely along the joint line formed between the panels 56.

As depicted in FIG. 6, the channel 61 is proportioned so that when two panels are inter-engaged, the apparent space, designated 64, between the panels when viewed from below, is the same as a gap between two panels with standard sidewall configurations. The side of the channel 61 remote from its associated panel 56 has an in-turned lip 67 that serves the function of a lip or edge 17 of a standard grid runner 11, 12.

Figure 8:
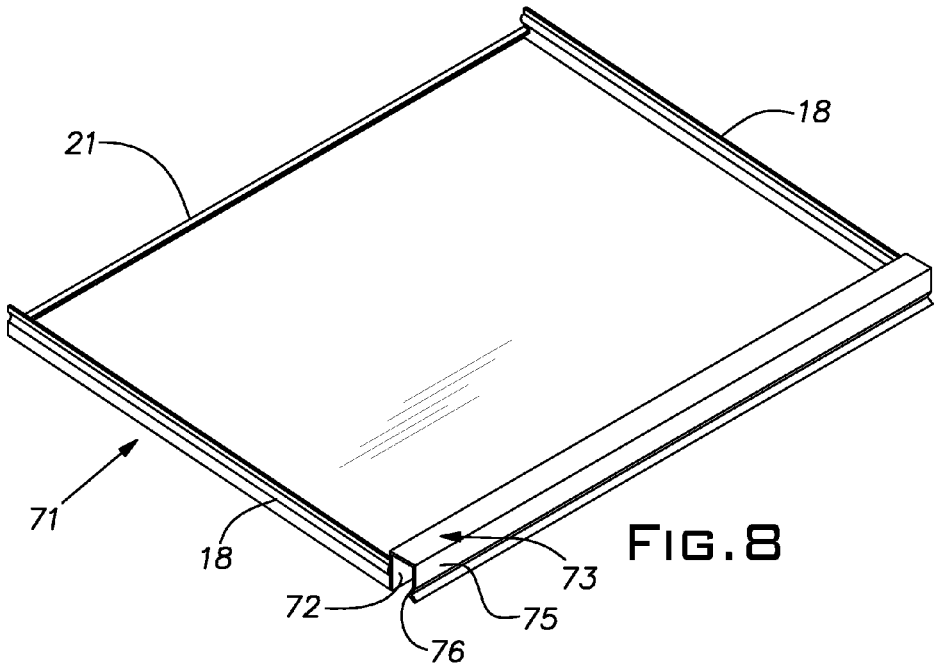
FIG. 8 is a fragmentary isometric view of a ceiling panel in accordance with a further embodiment of the invention.

FIG. 8 illustrates still another embodiment of the invention in the form of a modified snap-up panel 71. The panel 71 like the other panels described herein is nominally a 2'×2' unit having the characteristic pan shape of a snap-up panel. The panel 71 includes three sidewalls 18, 19 with the sidewall 19 having a hinge functioning flange 21.

Figure 9:
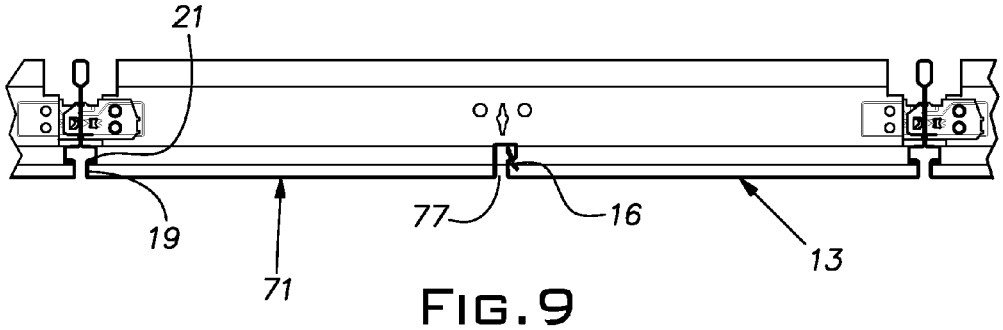
FIG. 9 is a fragmentary elevational view of a suspended ceiling employing the panel of FIG. 8.

FIG. 9 is a schematic elevational fragmentary view of a ceiling system utilizing the panel of FIG. 8. One sidewall 72 of the panel 71 has an inverted channel 73 extending across substantially its full length. The illustrated channel 73 is integral with the remainder of the sidewall 72 and is located on a side 74 remote from the hinge flange 21. The channel 73, at an outer wall 75, has an in-turned flange 76 that mimics the function of the lip or edge 17 of a standard runner. Similar to the panel 56 and associated inverted channel 61, the panel 71 and its inverted channel 73 are proportioned to produce a space 77 between the panel edge and adjacent panel 13 that when viewed from below has the same width as a gap between two other panels 13 of standard or hinge design.

Regarding the arrangement of FIGS. 5-7, the panels 56 can be hinged downwardly or removed to provide an opening of roughly 2'×4'. Regarding the arrangement of FIGS. 8 and 9, when the specialized panel 71 and a mating hinged panel 13 are swung downwardly about their respective hinge functioning flanges 21, an opening of about 2'×4' is made available. It will be understood that in all of the embodiments of the invention, the panels surrounding the pairs of displaced panels can remain in place and are not required to be removed to release one of the disclosed removable cross runners. This includes those panels adjacent the ends of the removable cross runners; this is true even in the case of the embodiment of FIGS. 3 and 3A because the deflection of the intersection runner 12 required for removal of the cross runner 36 is minimal.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A suspended ceiling comprising a grid formed of intersecting slot style grid runners and snap-up panels supported on the grid runners, the grid runners dividing a ceiling area into standard modules, the panels being formed of sheet material and each being fit within a module while having sides with lengths proportioned to leave a gap at visible faces of the panels between adjacent panels when in an installed position on the grid, at least one adjacent pair of panels being displaceable in a hinge-like manner from their installed positions, the gap between a pair of displaceable panels being closed by a runner removable while allowing slot style runners which it intersects to remain in normal assembled positions for supporting snap-up panels or by the displaceable panels so that when the displaceable panels are displaced from their installed position and any removable runner is removed, an access opening of twice the standard module is made available for accessing the area above the ceiling while adjacent panels at longitudinal ends of the gap between the displaceable panels can remain in respective installed positions, the removable runner having two connectors at each end, each connector having a tab that indexes to a respective opening in a web of an intersecting grid runner, the tabs of at least one pair of the connectors being arranged to be withdrawn from the respective openings while adjacent panels installed on the grid on a side of the intersecting grid runner opposite a side of the intersecting grid runner at which the connectors associated with the tabs are assembled from remain installed on the grid.

2. A suspended ceiling comprising a grid formed of intersecting slot style grid runners and snap-up panels supported on the grid runners, the grid runners dividing a ceiling area into standard modules, the panels being formed of sheet material and each being fit within a module while having sides with lengths proportioned to leave a gap at visible faces of the panels between adjacent panels when in an installed position on the grid, at least one adjacent pair of panels being displaceable in a hinge-like manner from their installed positions, the gap between a pair of displaceable panels being closed by a runner removable while allowing slot style runners which it intersects to remain in normal assembled positions for supporting snap-up panels or by the displaceable panels so that when the displaceable panels are displaced from their installed position and any removable runner is removed, an access opening of twice the standard module is made available for accessing the area above the ceiling while adjacent panels at longitudinal ends of the gap between the displaceable panels can remain in respective installed positions, one or both of the displaceable panels having an inverted channel above the plane of a main face of the respective panel at an edge adjacent the other of the pair of displaceable panels disposed to fully bridge the gap between said displaceable panels.

3. A suspended ceiling comprising a grid formed of intersecting slot style grid runners and snap-up panels supported on the grid runners, the grid runners dividing a ceiling area into standard modules, the panels being formed of sheet material and each being fit within a module while having sides with lengths proportioned to leave a gap at visible faces of the panels between adjacent panels when in an installed position on the grid, at least one adjacent pair of panels being displaceable in a hinge-like manner from their installed positions, the gap between a pair of displaceable panels being closed by a runner removable while allowing slot style runners which it intersects to remain in normal assembled positions for supporting snap-up panels or by the displaceable panels so that when the displaceable panels are displaced from their installed position and any removable runner is removed, an access opening of twice the standard module is made available for accessing the area above the ceiling while adjacent panels at longitudinal ends of the gap between the displaceable panels can remain in respective installed positions, the removable runner having on at least one end a connector that is longitudinally slidably mounted on the removable runner, wherein the slidably mounted connector arranged when extended passes through an associated opening in a web of the intersecting grid runner and when retracted is withdrawn from said opening.

* * * * *

UNITED STATES PATENT AND TRADEMARK OFFICE

CERTIFICATE OF CORRECTION

PATENT NO. : 8,484,923 B2
APPLICATION NO. : 12/960580
DATED : July 16, 2013
INVENTOR(S) : Alan C. Wendt It is certified that error appears in the above-identified patent and that said Letters Patent is hereby corrected as shown below:

In the Claims

Column 6, line 55 (Claim 10, line 22), delete "arranged".

Signed and Sealed this
Twenty-seventh Day of August, 2013

Teresa Stanek Rea
*Acting Director of the United States Patent and Trademark Office*